US009759508B2

(12) United States Patent
McPherson

(10) Patent No.: US 9,759,508 B2
(45) **Date of Patent: *Sep. 12, 2017**

(54) ARCHERY BOW

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/869,665

(22) Filed: Sep. 29, 2015

(65) Prior Publication Data

US 2016/0018183 A1 Jan. 21, 2016

Related U.S. Application Data

(63) Continuation of application No. 14/155,189, filed on Jan. 14, 2014, now Pat. No. 9,146,072, which is a continuation of application No. 13/100,128, filed on May 3, 2011, now Pat. No. 8,627,810, which is a continuation-in-part of application No. 29/355,277, filed on Feb. 4, 2010, now Pat. No. Des. 637,255, and a continuation-in-part of application No. 29/355,284, filed on Feb. 4, 2010, now Pat. No. Des. 637,679, and a continuation-in-part of application No. 29/355,289, filed on Feb. 4, 2010, now Pat. No. Des. 637,256, and a continuation-in-part of application No. 29/355,290, filed on Feb. 4, 2010, now Pat. No. Des. 637,257.

(51) Int. Cl.

| | |
|---|---|
| ***F41B 5/00*** | (2006.01) |
| ***F41B 5/10*** | (2006.01) |
| ***F41B 5/14*** | (2006.01) |

(52) U.S. Cl.

CPC ..... *F41B 5/10* (2013.01); *F41B 5/00* (2013.01); *F41B 5/105* (2013.01); *F41B 5/14* (2013.01); *F41B 5/1403* (2013.01)

(58) Field of Classification Search

CPC ..... F41B 5/00; F41B 5/10; F41B 5/14

See application file for complete search history.

(56) References Cited

U.S. PATENT DOCUMENTS

| | | | | |
|---|---|---|---|---|
| 3,923,036 | A | 12/1975 | Jennings | |
| D297,965 | S | 10/1988 | Luse | |
| 4,966,124 | A | 10/1990 | Burling | |
| 5,335,645 | A * | 8/1994 | Simonds | F41B 5/0031 124/23.1 |
| 5,701,880 | A | 12/1997 | Simonds | |
| 5,762,060 | A | 6/1998 | Larson | |
| 5,803,070 | A | 9/1998 | Martin et al. | |
| 5,842,460 | A | 12/1998 | Barber | |
| 5,921,227 | A | 7/1999 | Allshouse | |
| D439,627 | S | 3/2001 | D'Acquisto | |
| 6,321,736 | B1 | 11/2001 | McPherson | |

(Continued)

*Primary Examiner* — John Ricci

(57) ABSTRACT

An archery bow comprises a structural riser that comprises a plurality of cells arranged in a repeating pattern. In some embodiments, the riser comprises multiple pluralities of similarly shaped cells, wherein each plurality comprises a different shape. In some embodiments, a bow comprises one or more rotatable members. Each rotatable member can comprise a plurality of cells arranged in a repeating pattern. In some embodiments, cell shapes in the rotatable member (s) are similar to cell shapes in the riser.

18 Claims, 8 Drawing Sheets

(56) References Cited

U.S. PATENT DOCUMENTS

| | | | | |
|---|---|---|---|---|
| 6,516,790 | B1 | 2/2003 | Darlington | |
| 6,662,798 | B1 | 12/2003 | Johnson | |
| D503,958 | S | 4/2005 | Kronengold et al. | |
| 6,988,495 | B1 | 1/2006 | Van Hoorn | |
| D528,625 | S | 9/2006 | Blosser et al. | |
| 7,383,834 | B2 | 6/2008 | Budd | |
| 7,597,095 | B2 | 10/2009 | Grace, Jr. et al. | |
| 7,699,045 | B1 | 4/2010 | Kronengold et al. | |
| 7,784,452 | B1 | 8/2010 | Kronengold et al. | |
| 7,918,218 | B1 | 4/2011 | Kronengold et al. | |
| D637,255 | S | 5/2011 | McPherson | |
| D637,256 | S | 5/2011 | McPherson | |
| D637,257 | S | 5/2011 | McPherson | |
| D637,679 | S | 5/2011 | McPherson | |
| 8,028,685 | B2 | 10/2011 | Clark | |
| 8,266,933 | B2 | 9/2012 | Bishir, Jr. et al. | |
| 8,425,820 | B2 | 4/2013 | Pilpel | |
| 8,627,810 | B2 * | 1/2014 | McPherson ..... | F41B 5/10 124/23.1 |
| 9,146,072 | B2 * | 9/2015 | McPherson ..... | F41B 5/10 |
| 2007/0101980 | A1 | 5/2007 | Sims et al. | |
| 2007/0193567 | A1 | 8/2007 | D'Acquisto | |
| 2007/0246032 | A1 | 10/2007 | Budd | |
| 2008/0236557 | A1 | 10/2008 | Budd | |

* cited by examiner

ARCHERY BOW

CROSS-REFERENCE TO RELATED APPLICATIONS

This application is a continuation of U.S. patent application Ser. No. 14/155,189, filed Jan. 1, 2014, now U.S. Pat. No. 9,146,072, which is a continuation of U.S. patent application Ser. No. 13/100,128, filed May 3, 2011, now U.S. Pat. No. 8,627,810, which is a continuation-in-part of each of U.S. patent application Ser. Nos. 29/355,277, 29/355,284, 29/355,289 and 29/355,290, each filed Feb. 4, 2010, the entire disclosures of which are hereby incorporated herein by reference.

BACKGROUND OF THE INVENTION

This invention relates generally to archery bows. Bows and the various structural components of bows must have the strength and resiliency to perform properly through repeated firing cycles. The weight of a given component will generally increase with its strength; however, there is also a desire for bows to be as light as possible.

There remains a need for novel structural designs in bows that allow for increased performance and weight reduction.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a bow comprises a riser, first and second limbs and a bowstring extending between the limbs. The riser comprises a first rail, a second rail and a plurality of connecting members. At least a portion of the connecting members are oriented in a repeating pattern and define a plurality of similarly shaped cells.

In some embodiments, the connecting members comprise a plurality of first connecting members and a plurality of second connecting members. The first connecting members are oriented parallel to one another. The second connecting members are oriented parallel to one another and non-parallel to the first connecting members.

In some embodiments, the cells comprise squares. In some embodiments, the cells comprise triangular shapes. In some embodiments, the cells comprise hexagons.

In some embodiments, one or more rotatable members each comprise a repeating pattern and defining a plurality of similarly shaped cells. In some embodiments, the cells of a rotatable member are similar to the cells of the riser.

In some embodiments, an alternating cell configuration is used in a riser in the grip area.

In some embodiments, a rotatable member for use with an archery bow comprises a body defining a perimeter and a plurality of connecting members, wherein at least a portion of the connecting members are oriented in a repeating pattern and define a plurality of similar cells.

In some embodiments, a bow further comprises an archery accessory having a body that defines a plurality of similar cells arranged in a repeating pattern. In various embodiments, the pattern defined by the accessory may be similar to or different from repeating cell arrangements in other portion(s) of the bow.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
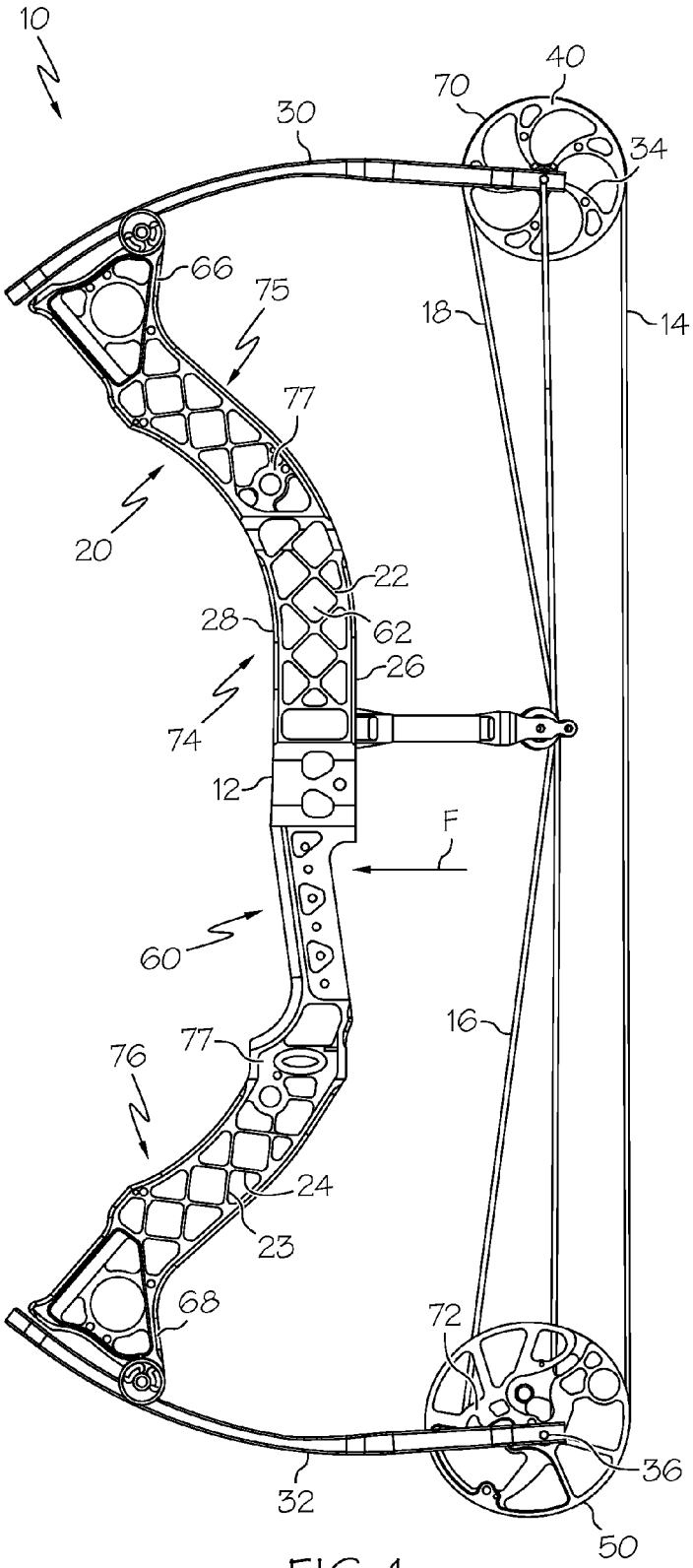
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a repetitive structural reinforcing pattern 20. The bow 10 comprises a riser 12, a first limb 30, a second limb 32 and a bowstring 14 extending between the limbs 30, 32. The bow 10 further comprises a rotatable member 40, 50 mounted on respective axles 34, 36, with each axle 34, 36 supported by a limb 30, 32. As shown, the bow 10 comprises a single cam compound bow, wherein the first rotatable member 40 is a pulley 70 and the second rotatable member 50 is a cam 72. The bowstring 14 wraps around the pulley 70 and further comprises a control cable portion 18 that attaches to a feed-out of the second rotatable member 50. The bow 10 includes a power cable 16 that attaches between the cam 70 and the first limb 30 (e.g. the first axle 34).

The riser 12 experiences several different loading conditions as the bow 10 is used. As the bow 10 is drawn, an archer will grasp the riser 12 in the area of the grip 60, wherein a force F is placed on the riser 12. The force F counteracts opposing forces applied to the ends 66, 68 of the riser 12 by the limbs 30, 32. The limbs 30, 32 also apply moment forces to the riser 12. After an arrow is fired, the forces in the riser 12 will reverse several times as the bow 10 oscillates and vibrates subsequent to the shot.

It is desirable for the riser 12 to be as light as possible while still providing the necessary strength to withstand the forces experienced during normal use. Further, the riser 12 and other components of the bow 10 are desirably string enough to withstand other forces that may be applied to a bow 10, such as impact forces if the bow 10 is dropped.

In some embodiments, the riser 12 comprises a first rail 26 and a second rail 28. In some embodiments, the first rail 26 extends continuously from the first end 66 to the second end 68 of the riser 12. In some embodiments, the first rail 26 is primarily a compression member when the bow 10 is drawn. In some embodiments, the second rail 28 extends continuously from the first end 66 to the second end 68 of the riser 12. In some embodiments, the second rail 28 is primarily a tension member when the bow 10 is drawn.

In some embodiments, the riser 12 comprises a plurality of connecting members 22. In some embodiments, a connecting member 22 connects at one end to the first rail 26 and connects at another end to the second rail 28. In some embodiments, a connecting member 22 is attached to another connecting member 22. Desirably, the riser 12 comprises a plurality of connecting members 22 oriented in a repeating pattern. The riser 12 defines a plurality of cells 62, and the repeating pattern of connecting members 22 defines a plurality of cells 62 that have a similar shape.

In some embodiments, the riser 12 comprises several portions that include connecting members 22 oriented in a repeating pattern. In some embodiments, the riser 12 comprises a first portion 74 and a second portion 75, each portion 74, 75 comprising connecting members 22 oriented in a repeating pattern. In some embodiments, the structure of the riser 12 interrupts the repeating pattern between the first portion 74 and second portion 75. For example, the riser 12 of FIG. 1 includes an accessory mounting location 77 between the first portion 74 and second portion 75. In some embodiments, the connecting members 22 of the first portion 74 that are oriented in a repeating pattern generally have a different orientation than the connecting members 22 of the second portion 75 that are oriented in a repeating pattern.

In some embodiments, the riser 12 comprises a third portion 76 comprising connecting members 22 oriented in a repeating pattern. In some embodiments, the structure of the riser 12 interrupts the repeating pattern between the first portion 74 and third portion 76. For example, the riser 12 of FIG. 1 includes a grip 60 and an accessory mounting location 77 between the first portion 74 and third portion 76. In some embodiments, the connecting members 22 of the first portion 74 that are oriented in a repeating pattern generally have a different orientation than the connecting members 22 of the third portion 76 that are oriented in a repeating pattern.

Figure 2:
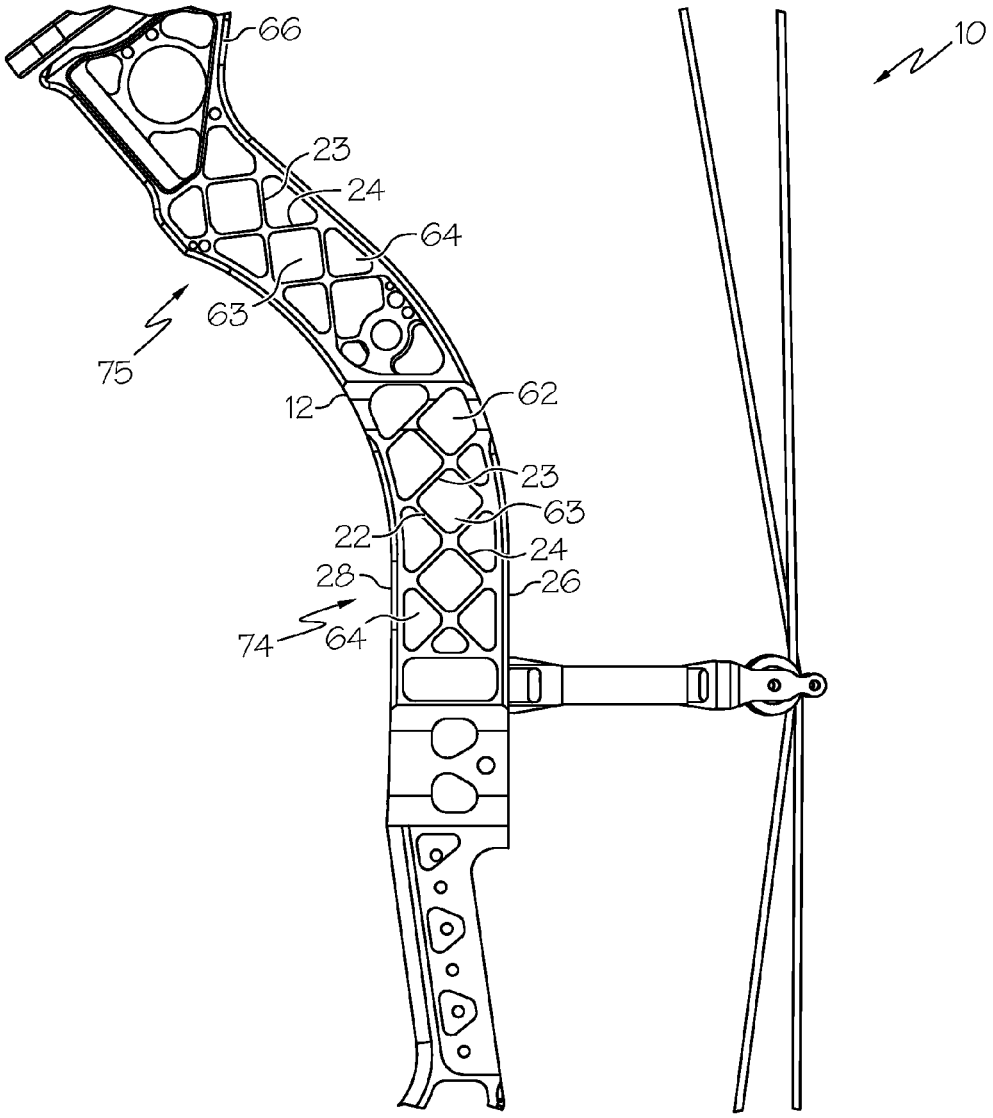
FIG. 2 shows a portion of FIG. 1 in greater detail.

FIG. 2 shows a portion of the bow 10 of FIG. 1 in greater detail. In some embodiments, the connecting members 22 include a plurality of first connecting members 23 that are each straight and oriented parallel to one another. The connecting members 22 further include a plurality of second connecting members 24 that are each straight and oriented parallel to one another, and non-parallel to the first connecting members 23.

In some embodiments, first connecting members 23 are perpendicular to second connecting member 24.

A riser 12 defines a plurality of cells 62. In some embodiments, a cell 62 is defined entirely by connecting members 22. In some embodiments, a cell 62 is defined by a plurality of first connecting members 23 and a plurality of second connecting members 24. In some embodiments, a riser 12 defines a plurality of first cells 63, wherein each first cell 63 comprises a similar shape and size. In some embodiments, a first cell 63 is bounded entirely by connecting members 22. In some embodiments, a first cell 63 is bounded entirely by first connecting members 23 and second connecting members 24.

In some embodiments, first cells 63 comprise a square shape or a substantially square shape.

In some embodiments, a riser 12 defines a plurality of second cells 64, wherein each second cell 64 comprises a substantially similar shape and size. In some embodiments, a second cell 64 is bounded by a rail 26, 28 and one or more connecting members 22. In some embodiments, a second cell 64 is bounded by a rail 26, 28, a first connecting member 23 and a second connecting member 24.

In some embodiments, second cells 64 comprise a triangular shape or a substantially triangular shape.

In some embodiments, connecting members 22 located in the first portion 74 of the riser and connecting members 22 located in the second portion 75 of the riser can have a similar size and shape, but the specific orientation can change between the portions 74, 75. For example, both portions 74, 75 in FIG. 2 show first and second connecting members 23, 24 oriented perpendicular to one another and defining a plurality of first cells 63, but the first cells 63 in the first portion 74 have a different orientation than the first cells 63 in the second portion 75. Thus, in some embodiments, the first connecting members 23 of the first portion 74 are non-parallel to the first connecting members 23 of the second portion 75.

Referring again to FIG. 1, in some embodiments, connecting members 22 located in the first portion 74 of the riser and connecting members 22 located in the third portion 76 of the riser can have a similar size and shape, but the specific orientation can change between the portions 74, 76. For example, both portions 74, 76 show first and second connecting members 23, 24 oriented perpendicular to one another and defining a plurality of first cells 63, but the first cells 63 in the first portion 74 have a different orientation than the first cells 63 in the third portion 76. Thus, in some embodiments, the first connecting members 23 of the first portion 74 are non-parallel to the first connecting members 23 of the third portion 76.

Similarly, in some embodiments, connecting members 22 located in the second portion 75 of the riser and connecting members 22 located in the third portion 76 of the riser can have a similar size and shape, but the specific orientation can change between the portions 75, 76. For example, both portions 75, 76 show first and second connecting members 23, 24 oriented perpendicular to one another and defining a plurality of first cells 63, but the first cells 63 in the second portion 75 have a different orientation than the first cells 63 in the third portion 76. Thus, in some embodiments, the first connecting members 23 of the second portion 75 are non-parallel to the first connecting members 23 of the third portion 76.

In various embodiments, a riser 12 can have any suitable configuration of connecting members 22 that form cells 63 of any suitable shape. In various embodiments, the cells 63 can have any suitable number of sides, with the more common embodiments comprising 3, 4 or 6 sides.

Figure 3:
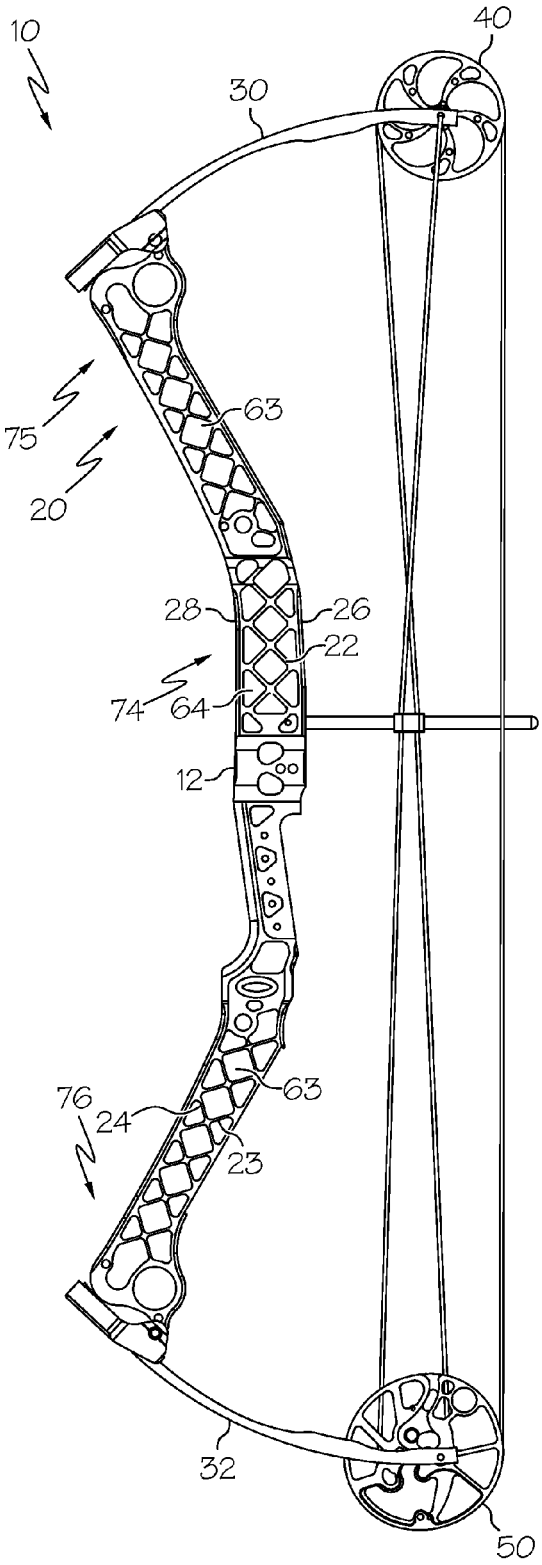
FIG. 3 shows another embodiment of an archery bow.

FIG. 3 shows another embodiment of a bow 10 comprising a repetitive structural reinforcing pattern 20. The riser 12 comprises first, second and third portions 74, 75, 76, each portion 74, 75, 76 comprising a repetitive structural reinforcing pattern 20. The riser 12 comprises first and second rails 26, 28, and a plurality of connecting members 22. Each portion 74, 75, 76 comprises connecting members 22, including first connecting members 23 and second connecting members 24 oriented perpendicularly to one another.

The riser 12 comprises a plurality of first cells 63, each having a similar size and shape. The riser 12 comprises a plurality of second cells 64, each having a substantially similar size and shape.

In some embodiments, a riser 12 comprises at least six first cells 63. In some embodiments, a riser comprises at least nine first cells 63. In some embodiments, a riser 12 comprises at least twelve first cells 63. In some embodiments, each portion 74, 75, 76 comprises at least two first cells 63. In some embodiments, each portion 74, 75, 76 comprises at least three first cells 63. In some embodiments, the first portion 74 comprises fewer first cells 63 than the second portion 75. In some embodiments, the second portion 75 comprises fewer first cells 63 than the third portion 76.

Figure 4:
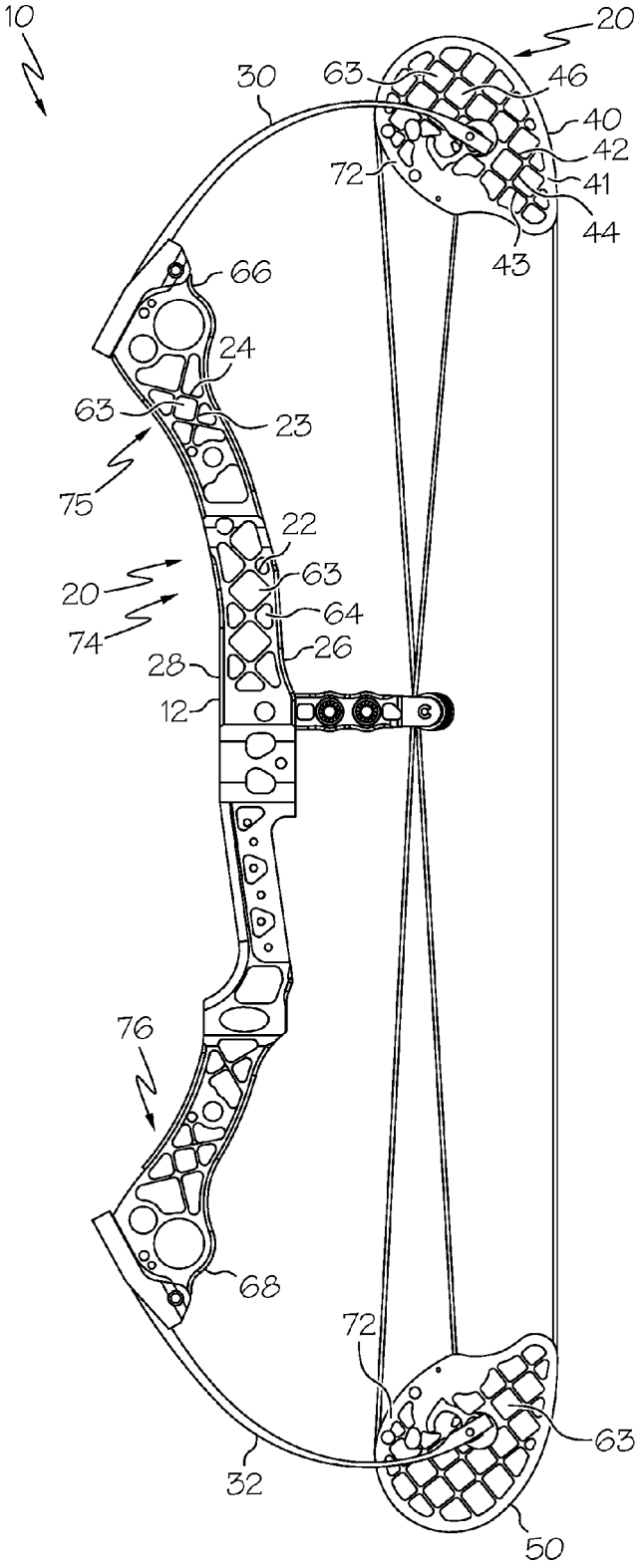
FIG. 4 shows another embodiment of an archery bow.

FIG. 4 shows another embodiment of a bow 10 comprising a repetitive structural reinforcing pattern 20. The bow 10 comprises a dual cam bow wherein both the rotatable members 40, 50 comprise cams 72. In some embodiments, the first and second rotatable members 40, 50 comprise mirror images of one another.

The riser 12 comprises first, second and third portions 74, 75, 76, each portion 74, 75, 76 comprising a repetitive structural reinforcing pattern 20. The riser 12 comprises first and second rails 26, 28, and a plurality of connecting members 22. Each portion 74, 75, 76 comprises connecting members 22, including first connecting members 23 and second connecting members 24 oriented perpendicularly to one another.

The riser 12 comprises a plurality of first cells 63, each having a similar size and shape. The riser 12 comprises a plurality of second cells 64, each having a substantially similar size and shape.

In some embodiments, a first cell 63 located in the first portion 74 and a first cell 63 located in the second portion 75 comprise a similar shape but have different sizes. For example, the cell size may decrease in the second portion 75. The cell size may similarly decrease when a first cell 63 located in the first portion 74 is compared to a first cell 63 located in the third portion 76. In some embodiments, first cells 63 located in the second and third portions 75, 76 have a similar size and shape, and their size is smaller than first cells 63 located in the first portion 74. Thus, cell size may be larger toward the middle of the riser 12 and smaller toward the ends 66, 68.

In some embodiments, a rotatable member 40, 50 comprises a repetitive structural reinforcing pattern 20. In some embodiments, the repetitive pattern used in a rotatable member 40 is similar to the repetitive pattern used in a riser 12 and/or other portions of a bow as herein described. For example, in some embodiments, a riser 12 comprises a plurality of similarly shaped cells 63, and a rotatable member 40 comprises a plurality of cells having a similar shape.

In some embodiments, a repeating pattern 20 used in a rotatable member 40 is different from a repeating pattern used in a riser 12 or other portion of a bow 10.

In some embodiments, a rotatable member 40 comprises a perimeter member 41 and a plurality of connecting members 42. In some embodiments, the connecting members 42 include a plurality of first connecting members 43 that are oriented parallel to one another. In some embodiments, the connecting members 42 include a plurality of second connecting members 44 that are oriented parallel to one another and non-parallel to the first connecting members 43.

In some embodiments, the first connecting members 43 are perpendicular to the second connecting members 44. In some embodiments, a rotatable member 40 comprises a plurality cells 46, each having a square or substantially square shape.

In some embodiments, a rotatable member 40 comprises a plurality of cells 46 that are defined by the connecting members 42. For example, in some embodiments, a rotatable member 40 comprises a plurality of cells 46 that are defined entirely by first and second connecting members 43, 44.

In some embodiments, a rotatable member 40 comprises at least three similarly shaped cells 46. In some embodiments, a rotatable member 40 comprises at least six similarly shaped cells 46. In some embodiments, a rotatable member 40 comprises at least nine similarly shaped cells 46. A rotatable member 40 can comprise any suitable number of similarly shaped cells 46.

A rotatable member 40 having a repetitive structural reinforcing pattern 20 desirably exhibits beneficial qualities when compared to prior rotatable members, which often included fewer reinforcing members oriented in radial directions. For example, a rotatable member 40 having a repetitive structural reinforcing pattern 20 can provide a more uniform mass having a centroid located closer to an axis of rotation. Further, a rotatable member 40 having a repetitive structural reinforcing pattern 20 desirably exhibits better impact characteristics that prior designs. When a bow is dropped, it will often land on a rotatable member 40. Such an impact can damage and deform the rotatable member 40. A repetitive structural reinforcing pattern 20 can better distribute such impact loads and resist plastic deformation due to the impact.

In some embodiments, a first rotatable member 40 comprises a first repetitive structural reinforcing pattern 20, and a second rotatable member 50 comprises a second repetitive structural reinforcing pattern 20 different than the first pattern, for example having a different repeating cell shape.

Figure 5:
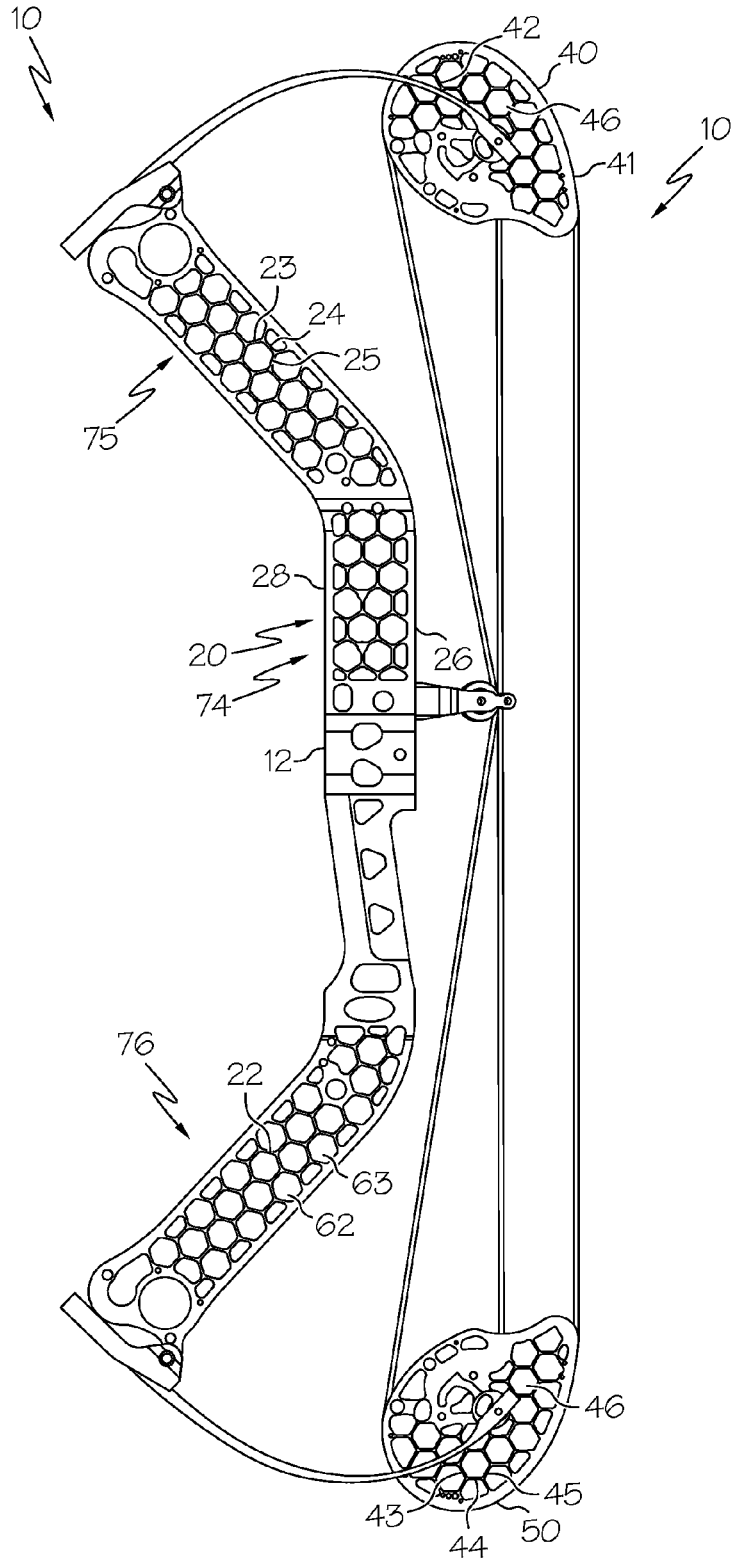
FIG. 5 shows another embodiment of an archery bow.

FIG. 5 shows another embodiment of a bow 10 having a repetitive structural reinforcing pattern 20. The bow includes similar repetitive cell shapes in the riser 12 and rotatable members 40, 50.

The riser 12 comprises first and second rails 26, 28 and a plurality of connecting members 22. The connecting members 22 comprise first connecting members 23 that are each straight and parallel to one another. The connecting members 22 further include a plurality of second connecting members 24 that are each straight and oriented parallel to one another, and non-parallel to the first connecting members 23. The connecting members 22 further include a plurality of third connecting members 25 that are each straight and oriented parallel to one another, and non-parallel to the first connecting members 23 and non-parallel to the second connecting members 24.

In some embodiments, an angle between first connecting members 23 and second connecting members 24 is approximately 120 degrees. An angle between second connecting members 24 and third connecting members 25 is approximately 120 degrees. An angle between first connecting members 23 and third connecting members 25 is approximately 120 degrees.

In some embodiments, cells 62 of the riser 12 are defined by the first, second and third connecting members 23, 24, 25. In some embodiments, the cells 62 comprise a hexagonal shape. In some embodiments, the first portion 74 of the riser 12 comprises at least four similarly shaped cells 63. In some embodiments, the first portion 74 of the riser 12 comprises at least eight similarly shaped cells 63. In some embodiments, the first portion 74 of the riser 12 comprises at least twelve similarly shaped cells 63. In some embodiments, the second portion 75 of the riser comprises at least four similarly shaped cells 63. In some embodiments, the second portion 75 of the riser comprises at least eight similarly shaped cells 63. In some embodiments, the second portion 75 of the riser comprises at least twelve similarly shaped cells 63. In some embodiments, the second portion 75 of the riser comprises at least sixteen similarly shaped cells 63. In some embodiments, the second portion 75 of the riser comprises at least eighteen similarly shaped cells 63. In some embodiments, the third portion 76 of the riser comprises at least four similarly shaped cells 63. In some embodiments, the third portion 76 of the riser comprises at least eight similarly shaped cells 63. In some embodiments, the third portion 76 of the riser comprises at least twelve similarly shaped cells 63. In some embodiments, the third portion 76 of the riser comprises at least sixteen similarly shaped cells 63. In some embodiments, the third portion 76 of the riser comprises at least eighteen similarly shaped cells 63.

In some embodiments, a rotatable member 40 comprises a perimeter member 41 and a plurality of connecting members 42. In some embodiments, the connecting members 42 include a plurality of first connecting members 43 that are oriented parallel to one another. In some embodiments, the connecting members 42 include a plurality of second connecting members 44 that are oriented parallel to one another and non-parallel to the first connecting members 43. In some embodiments, the connecting members 42 include a plurality of third connecting members 45 that are oriented parallel to one another and non-parallel to the first connecting members 43 and non-parallel to the second connecting members 44.

In some embodiments, the first connecting members 43 are oriented at a 120 degree angle to the second connecting members 44. In some embodiments, the first connecting members 43 are oriented at a 120 degree angle to the third connecting members 45. In some embodiments, the second connecting members 44 are oriented at a 120 degree angle to the third connecting members 45.

In some embodiments, a rotatable member 40 comprises a plurality cells 46, each having a hexagonal shape.

In some embodiments, a rotatable member 40 comprises a plurality of cells 46 that are defined by the connecting members 42. For example, in some embodiments, a rotatable member 40 comprises a plurality of cells 46 that are defined entirely by first, second and third connecting members 43, 44, 45.

In some embodiments, a rotatable member 40 comprises at least three similarly shaped cells 46. In some embodiments, a rotatable member 40 comprises at least six similarly shaped cells 46. In some embodiments, a rotatable member 40 comprises at least nine similarly shaped cells 46. A rotatable member 40 can comprise any suitable number of similarly shaped cells 46.

In some embodiments, the similarly shaped cells 46 of a rotatable member 40 have a size and shape that is the same as cells 63 of the riser 12.

Figure 6:
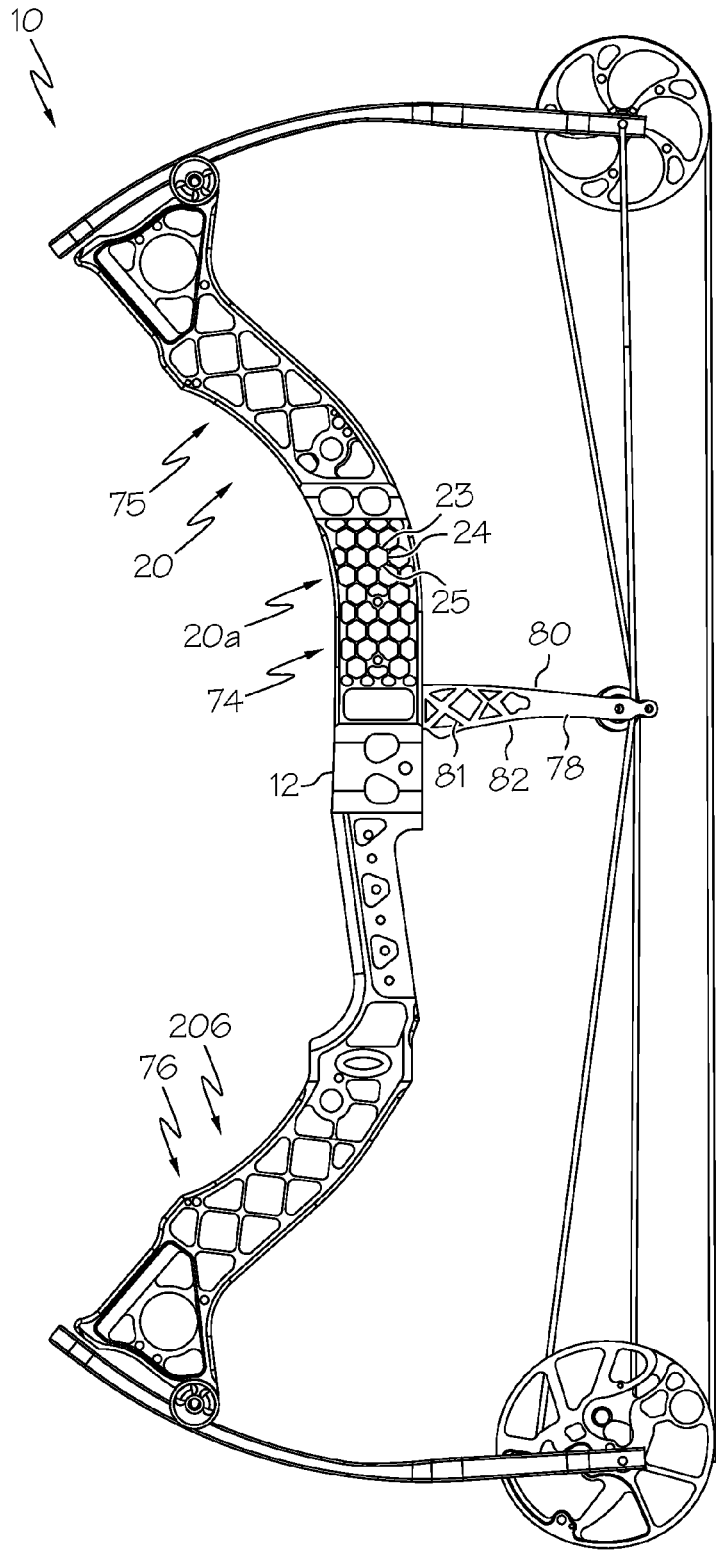
FIG. 6 shows another embodiment of an archery bow.

FIG. 6 shows another embodiment of a bow 10 comprising a repetitive structural reinforcing pattern 20. In some embodiments, a riser 12 comprises a first repetitive structural reinforcing pattern 20*a* and a second repetitive structural reinforcing pattern 20*b*. In some embodiments, the first pattern 20*a* comprises cells having different shapes than cells included in the second pattern 20*b*.

The riser 12 illustrated in FIG. 6 includes a first portion 74 comprising first, second and third connecting members 23, 24, 25 and hexagonal cells, similar to the reinforcing pattern illustrated in FIG. 5. The riser 12 of FIG. 6 also includes second and third portions 75, 76 that each comprise first and second connecting members 23, 24 and square cells, similar to the reinforcing pattern shown in FIG. 1.

In various embodiments, the various portions 74, 75, 76 of a riser 12 can each have any suitable repeating structural reinforcing pattern. In some embodiments, a riser 12 comprises at least two different configurations of a repeating pattern. In some embodiments, a riser 12 comprises at least three different configurations of a repeating pattern, for example, a different pattern in each respective portion 74, 75, 76.

In some embodiments, a bow 10 further comprises an accessory 78 that comprises a repeating pattern of structural reinforcing and/or cross members oriented similarly to connecting members 22 that create a repeating cell pattern. Desirably, the accessory comprises a plurality of cells that are shaped similarly to cells of the riser 12. For example, FIG. 6 shows a cable guard 78 comprising a top rail 80, a bottom rail 82 and a plurality of cross members 81. In some embodiments, cross members 81 comprise first and second cross members oriented perpendicular to one another, which form at least one cell having a square shape. In some embodiments, cross members 81 comprise first, second and third cross members oriented at approximately 120 degrees with respect to one another and forming at least one hexagonally shaped cell.

Figure 7:
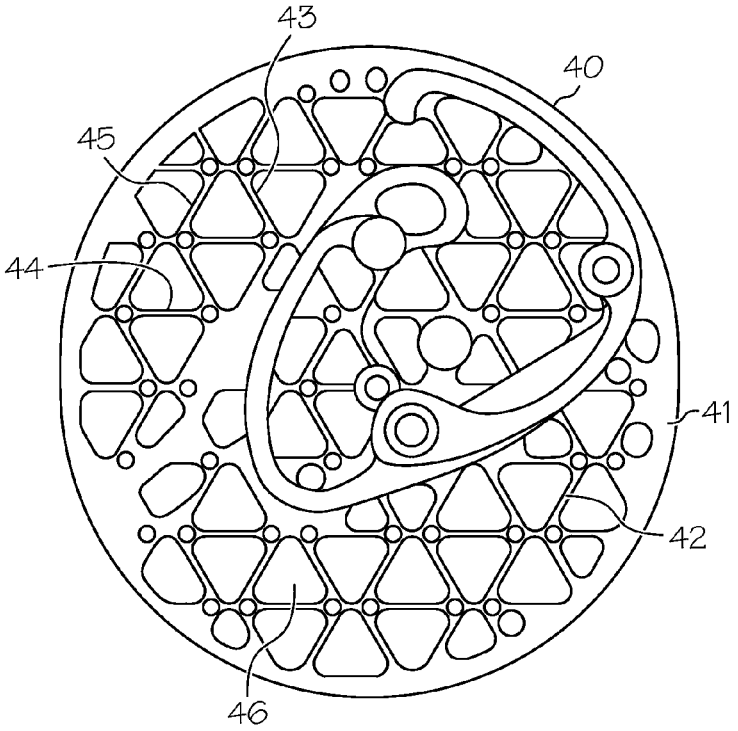
FIGS. 7 and 8 show views of an embodiment of a rotatable member suitable for use with an archery bow.
Figure 8:
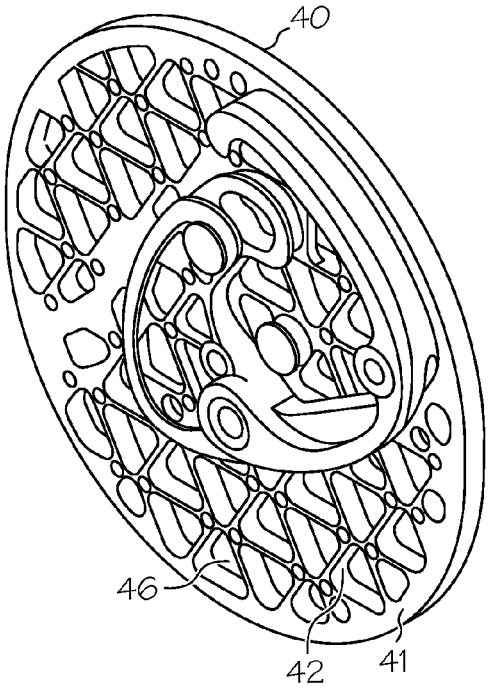

FIGS. 7 and 8 each show a view of an embodiment of a rotatable member 40. The rotatable member 40 comprises a perimeter member 41 and a plurality of connecting members 42. In some embodiments, the connecting members 42 include a plurality of first connecting members 43 that are oriented parallel to one another. In some embodiments, the connecting members 42 include a plurality of second connecting members 44 that are oriented parallel to one another and non-parallel to the first connecting members 43. In some embodiments, the connecting members 42 include a plurality of third connecting members 45 that are oriented parallel to one another and non-parallel to the first connecting members 43 and non-parallel to the second connecting members 44.

In some embodiments, the first connecting members 43 are oriented at a 60 degree angle to the second connecting members 44. In some embodiments, the first connecting members 43 are oriented at a 60 degree angle to the third connecting members 45. In some embodiments, the second connecting members 44 are oriented at a 60 degree angle to the third connecting members 45.

In some embodiments, a rotatable member 40 comprises a plurality cells 46, each having a triangular shape.

In some embodiments, a rotatable member 40 comprises a plurality of cells 46 that are defined by the connecting members 42. For example, in some embodiments, a rotatable member 40 comprises a plurality of cells 46 that are defined entirely by first, second and third connecting members 43, 44, 45.

In some embodiments, a rotatable member 40 comprises at least three similarly shaped cells 46. In some embodiments, a rotatable member 40 comprises at least six similarly shaped cells 46. In some embodiments, a rotatable member 40 comprises at least sixteen similarly shaped cells 46. In some embodiments, a rotatable member 40 comprises at least twenty similarly shaped cells 46. A rotatable member 40 can comprise any suitable number of similarly shaped cells 46.

The reinforcing pattern shown in the rotatable member of FIGS. 7 and 8, having triangular shaped cells 46, can also be used in other parts of the bow 10, such as the riser 12 or an accessory 78 (see FIG. 6).

An archery bow 10 can comprise any suitable combination of the various riser, rotatable member and accessory designs as disclosed herein. In some embodiments a first rotatable member 40 comprises a repeating cell shape that is different from a repeating cell shape used in a second rotatable member 50. Further, repeating cell shapes used in the riser 12 can be different from those of the rotatable members 40, 50.

In some embodiments, a riser 12 further comprises a pattern of cells and structural components located in the area of the grip 60, which lighten the riser 12 while providing appropriate strength.

Figure 9:
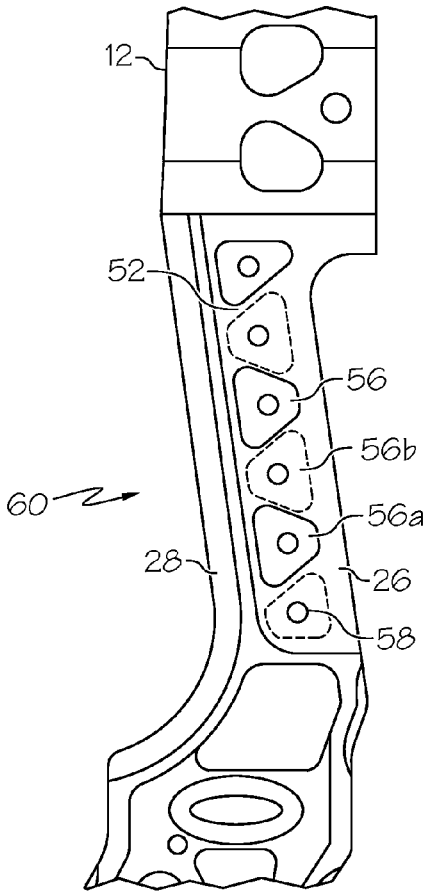
FIGS. 9-11 show an embodiment of a grip area of an archery bow riser.

FIG. 9 shows an example grip area 60 of a riser 12. The structure of the riser 12 under the grip 60 may be covered with a separate handle (not shown). The first rail 26 and second rail 28 of the riser 12 are continuous through the grip area 60. The grip area 60 comprises a plurality of cells 56. In some embodiments, the cells 56 extend laterally into the riser 12, wherein adjacent cells 56 extend into the riser 12 from opposite directions. For example, cell 56*a* shown in FIG. 9 extends into the riser 12 from a first side (e.g. left side of riser), and cell 56*b*, shown in hidden lines, extends into the riser 12 from a second side (e.g. right side of riser).

Figure 10:
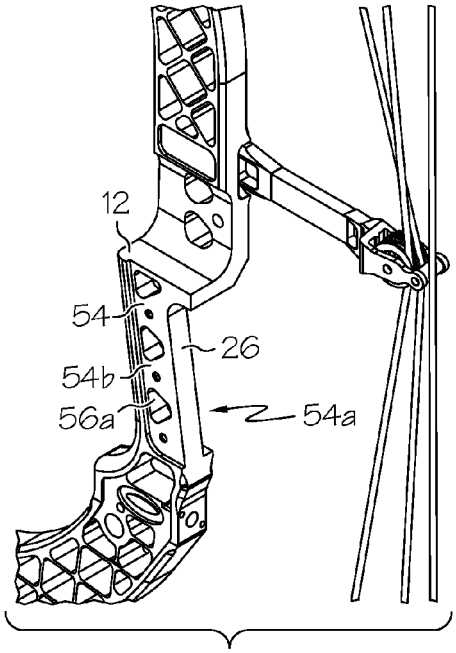
Figure 11:
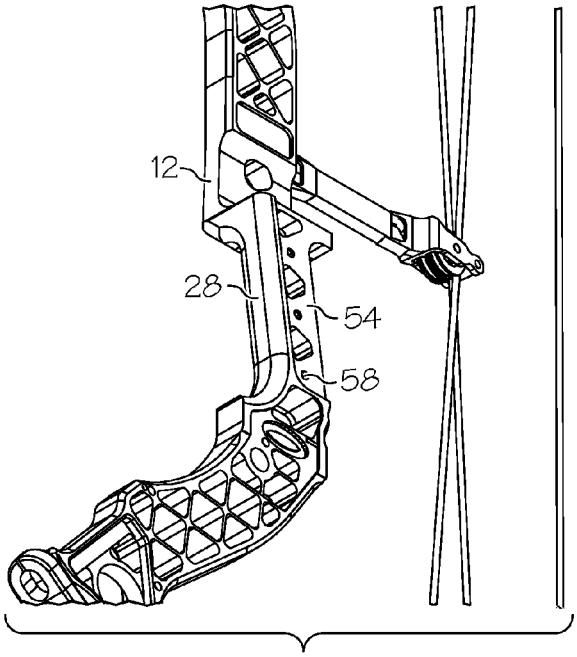

FIGS. 10 and 11 show additional views of the riser 12 of FIG. 9. The alternating cell 56 configuration is illustrated with additional detail.

In some embodiments, the grip area 60 can be considered to comprise the rails 26, 28 and a plurality of connecting members 52 extending between the rails 26, 28. The rails 26, 28 and connecting members 52 define cells 56. The grip area 60 further comprises a plurality of cell end plates 54, each end plate 54 forming a sidewall extending between the connecting members 52 and rails 26, 28. End plates 54 are generally oriented orthogonal to said connecting members 52. An end plate 54 is desirably thin, for example having a thickness less than a thickness of a connecting member 52. Desirably, the end plates 54 of adjacent cells are located on opposite sides of the riser 12. For example, referring to FIG. 10, an end plate 54*b* is labeled, which comprises a continuous surface on the left side of the riser 12. End plate 54*b* in FIG. 10 is actually the end plate 54 for the cell labeled 56*b* in FIG. 9. In FIG. 10, reference character 54*a* is labeled and points to an end plate 54*a* that comprises a continuous surface on the right side of the riser 12. Reference character 54*a* points to the end plate 54*a* of the cell labeled 56*a*. The alternating cell 56 and alternating end plate 54 configuration in the grip area 60 reduces weight of the riser 12. When the riser 12 is loaded as the bow is drawn, the end plates 54 act as shear walls to reduce deflection in the riser 12.

In some embodiments, the grip area 60 comprises a plurality of apertures 58. In some embodiments, a cell end plate 54 comprises an aperture 58. In some embodiments, each cell end plate 54 comprises an aperture 58.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A riser suitable for use in an archery bow, the riser comprising:

a body having a top end, a bottom end and a grip area;

the grip area comprising a first rail portion, a second rail portion, a first lateral sidewall, a second lateral sidewall, a first cell and a second cell;

the first cell comprising an opening in the first lateral sidewall, a portion of the second lateral sidewall comprising a floor of the first cell;

the second cell comprising an opening in the second lateral sidewall, a portion of the first lateral sidewall comprising a floor of the second cell.

2. The riser of claim 1, the grip area comprising a connecting member extending between the first rail portion and the second rail portion, the connecting member forming a sidewall portion of the first cell.

3. The riser of claim 2, the connecting member forming a sidewall portion of the second cell.

4. The riser of claim 1, the first cell comprising a plurality of straight sidewall portions.

5. The riser of claim 1, a cross-sectional shape of the first cell being similar to a cross-sectional shape of the second cell.

6. The riser of claim 1, comprising a plurality of first cells.

7. The riser of claim 6, comprising a plurality of second cells.

8. The riser of claim 7, wherein the first and second cells alternate along a length of the grip area.

9. The riser of claim 1, further comprising a handle arranged to cover the first cell and the second cell.

10. The riser of claim 1, comprising a first aperture formed in the second lateral sidewall, the first aperture in fluid communication with the first cell.

11. The riser of claim 10, wherein a cross-sectional area of the first aperture is less than a cross-sectional area of the first cell.

12. The riser of claim 10, comprising a second aperture formed in the first lateral sidewall, the second aperture in fluid communication with the second cell.

13. The riser of claim 1, the first cell comprising a substantially trapezoidal cross-sectional shape.

14. A bow comprising:

a riser, first and second limbs attached to the riser and a bowstring, the bow defining an arrow shooting axis;

the riser comprising a first rail portion, a second rail portion, a first lateral sidewall, a second lateral sidewall and a first cell, the first lateral sidewall and the second lateral sidewall located on opposites sides of the arrow shooting axis, the first cell comprising an opening in the first lateral sidewall, a portion of the second lateral sidewall comprising a floor of the first cell.

15. The bow of claim 14, the riser comprising a grip area, the first cell oriented in the grip area.

16. A bow comprising:

a riser, first and second limbs attached to the riser and a bowstring;

the riser comprising a first rail portion, a second rail portion, a first lateral sidewall, a second lateral sidewall, a first cell and a second cell, the first cell comprising an opening in the first lateral sidewall, a portion of the second lateral sidewall comprising a floor of the first cell, the second cell comprising an opening in the second lateral sidewall, a portion of the first lateral sidewall comprising a floor of the second cell.

17. The bow of claim 16, the riser comprising a connecting member extending between the first rail portion and the second rail portion, the connecting member forming a sidewall portion of the first cell.

18. The bow of claim 17, the connecting member forming a sidewall portion of the second cell.

* * * * *